US006619975B2

(12) United States Patent
Bentley et al.

(10) Patent No.: US 6,619,975 B2
(45) **Date of Patent: *Sep. 16, 2003**

(54) LOCKABLE ELECTRICAL RECEPTACLE

(76) Inventors: James K Bentley, P.O. Box 2848, Paso Robles, CA (US) 93447; Richard G Davidson, 1690 El Camino Real, Atascadero, CA (US) 93442

( * ) Notice: Subject to any disclaimer, the term of this patent is extended or adjusted under 35 U.S.C. 154(b) by 113 days.

This patent is subject to a terminal disclaimer.

(21) Appl. No.: 10/054,497

(22) Filed: Nov. 12, 2001

(65) Prior Publication Data

US 2003/0092306 A1 May 15, 2003

(51) Int. Cl.[7] ..... H01R 13/625
(52) U.S. Cl. ..... 439/346
(58) Field of Search ..... 439/346, 106, 439/102

(56) References Cited

U.S. PATENT DOCUMENTS 6,315,593 B1 * 11/2001 Bentley et al. ..... 439/346
6,428,339 B1 * 8/2002 Davidson et al. ..... 439/346
6,533,598 B1 * 3/2003 Bentley et al. ..... 439/346

* cited by examiner

*Primary Examiner*—Tho D. Ta
*Assistant Examiner*—James R. Harvey
(74) *Attorney, Agent, or Firm*—Charles C. Logan, II

(57) ABSTRACT

A lockable electrical receptacle for connection to the front end of a three wire electrical cord or extension cord. A first embodiment has a cylindrical housing formed of plastic electrically non-conductive material having a pair of laterally spaced electrical prong apertures formed in its front wall surface. There is a chamber and channels in the structure of the housing for receiving the left blade prong terminal, the right blade prong terminal and the ground prong terminal that are in communication with the electrical plug apertures. The rear ends of the respective prong terminals are electrically connected to the front end of an electrical cord. A shaft having a front end extends outwardly from the left side wall of the housing. The shafts have structure formed in their periphery that allows a predetermined number of degrees of rotation to lock the blade prongs of a male electrical plug in the electrical plug apertures after they have been inserted therein. The lockable electrical receptacle can be structured to receive either a single male electrical plug or multiple electrical plugs.

18 Claims, 4 Drawing Sheets

LOCKABLE ELECTRICAL RECEPTACLE

BACKGROUND OF THE INVENTION

The invention relates to an electrical connector and more specifically to one that can be locked onto a male electrical plug.

Extension cords have been used for may years to lengthen the cord of an electrical device so that it can reach a remote power supply or receptacle. One end of the extension cord has a female socket that is sized to engage with a plug located on the cord of the electrical device while the other end of the extension cord is formed with a plug which is adapted to engage with a socket located at the power supply.

Quite often, when the user is moving the electrical device the cord or the extension cord becomes entangled or caught, the extension cord becomes disconnected from the cord of the device or the power supply. When this occurs, the user is forced to discontinue operation and reestablish the electrical connection, thereby adding time to complete the task. Another problem is that when the extension cord partially disconnects from the power source, it has hot electrical contacts exposed to the user and the environment. In this situation, a person could accidently touch the electrical contacts and sustain injury or the electrical contact may short and cause a fire and/or damage to the device, power supply or user.

In order to prevent the extension cord from becoming disconnected from the electrical device, users have often resorted to means such as tying a knot in the cord of the device and the socket end of the extension cord to isolate the plug/socket connection from the induced stress. This method, is time consuming and can damage the insulation surrounding the conductor, and shortens the effective life of the cord.

To overcome the above disadvantages, extension cords have been designed with a variety of locking mechanisms to securely connect the extension cord to the device or power supply. One such extension cord is shown in U.S. Pat. No. 4,085,991. It utilizes structure allowing for engagement of the apertures formed in the prongs of a male electrical plug. Once engaged, the two members cannot be pulled apart and there is structure for releasing that engagement. A similar method of locking a connector onto the male prong of a male electrical plug is illustrated in U.S. Pat. No. 5,352,132.

Other prior art patents of interest are the following. The Chesler U.S. Pat. No. 3,691,327 discloses a circuit-closing adaptor having a key-operated lock means that closes the electrical circuit when the key is in the lock and which opens the circuit when the key is removed from the lock.

The Sherman U.S. Pat. No. 4,167,658 is directed to an electrical lock having a housing carrying a pair of prongs to be mounted in a conventional wall socket. It has a key operated cam in the housing that makes and breaks one of the contacts and latching means carried by that contact that mechanically locks onto the plug prong. The Solomon U.S. Pat. No. 4,579,410 is directed to a security attachment for an electrical plug that is effective to prevent unauthorized use and to readily permit authorized use.

The Windsor Jr. U.S. Pat. No. 4,875,874 is directed to a rotatable electrical connector arrangement for the secure snag free interlocking of the female end socket member of an electrical power extension cord, to the plug or male end member of an electrical power implement, or to any related device having a male plug member fixed to its power cord.

The Torok U.S. Pat. No. 5,108,301 is directed to a locking electrical cord connector that securely attaches at both the male and female end.

It is an object of the invention to provide a novel lockable electrical receptacle that can be installed on the female end of an electrical cord or an extension cord.

It is also an object of the invention to provide a novel lockable electrical receptacle that will prevent accidental disconnection.

It is another object of the invention to provide a novel lockable electrical receptacle that will prevent downtime previously caused by the electrical connections pulling apart.

It is an additional object of the invention to provide a novel lockable electrical receptacle that will reduce the cost of labor caused by downtime delays.

It is a further object of the invention to provide a novel lockable electrical receptacle that is easy and fast to install.

It is also an object of the invention to provide a novel lockable electrical connector that is inexpensive to manufacture and market.

SUMMARY OF THE INVENTION

The first embodiment of the lockable electrical receptacle has a cylindrical housing with a pair of laterally spaced electrical prong apertures and a ground pin aperture formed in its front wall. A left blade prong terminal and a right blade prong terminal and a ground pin socket are aligned rearwardly of the respective electrical prong apertures and the ground pin aperture. A transversely extending shaft having a knob on its front end extends a predetermined distance within cylindrical housing so that a transversely extending groove on its bottom surface aligns with the right and left blade prong of a male electrical plug prior to its insertion. This allows the male electrical plug to be freely inserted or removed. By rotating the knob, the shaft will cause one edge of the transversely extending groove in the bottom surface of the shaft to bind against the top edge of the left blade prong and prevent its removal from the lockable electrical receptacle.

The second embodiment of the lockable electrical receptacle functions in the same manner as the first embodiment but has a plurality of laterally spaced sets of electrical prong apertures so that a plurality of male electrical plugs can be inserted therein. The shaft would pass through almost the entire width of the bottom housing member and have its respective transversely extending grooves in its bottom surface aligned with their respective left prong electrical apertures.

DESCRIPTION OF THE PREFERRED EMBODIMENT

Figures 1, 2, 3:
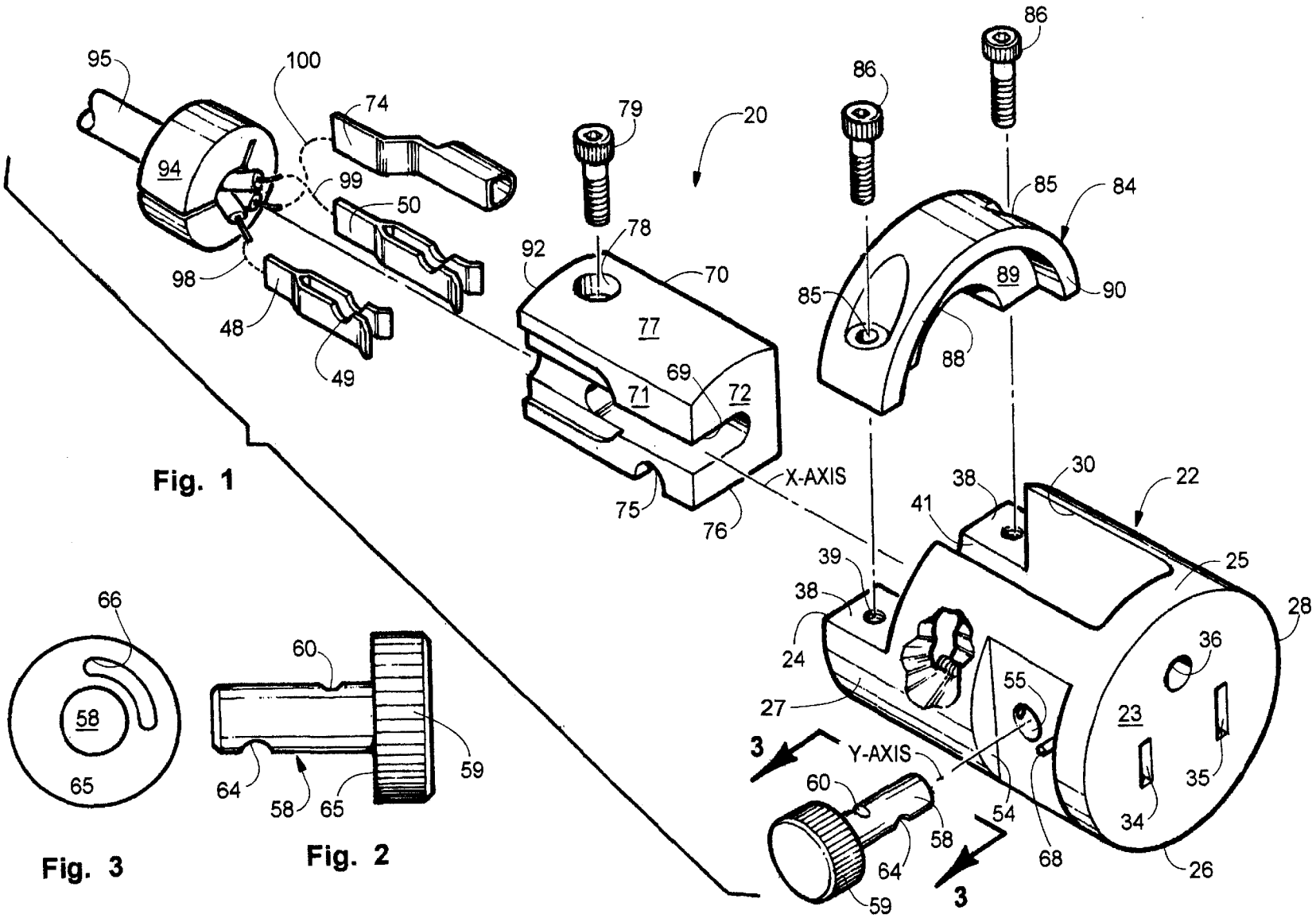
FIG. 1 is an exploded front perspective view of the novel lockable electrical receptacle.
FIG. 2 is an enlarged side elevation view of the shaft and finger-gripping knob attached thereto.
FIG. 3 is an enlarged rear elevation view taken along lines 3—3 of FIG. 1.
Figure 4:
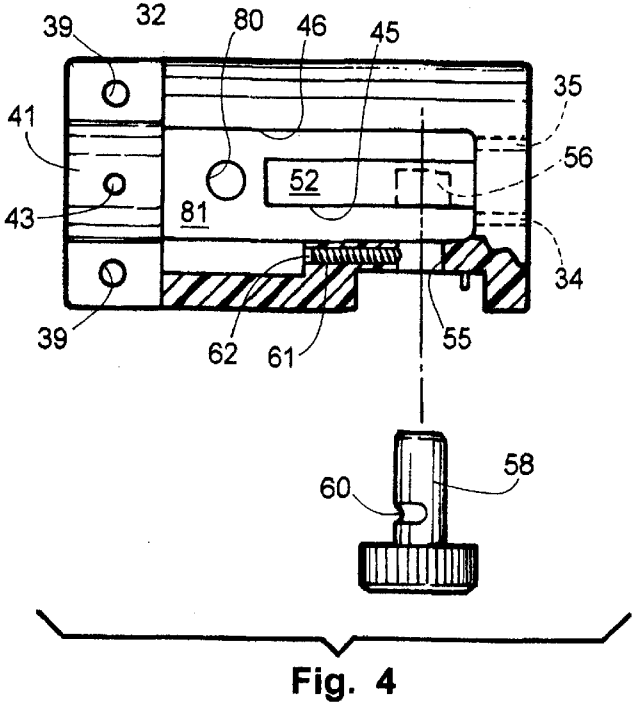
FIG. 4 is an exploded top plan view of the cylindrical housing and shaft with portions broken away.
Figure 5:
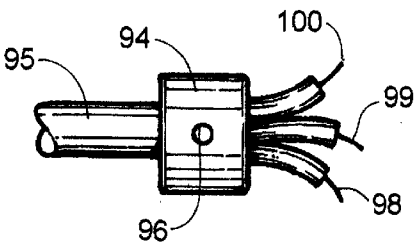
FIG. 5 is a partial bottom plan view of the front end of the electrical cord with attachment structure secured thereto.

The first embodiment of the lockable electrical receptacle will now be described by referring to FIGS. 1–7 of the drawings. The lockable electrical receptacle is generally designated numeral 20. Its primary component is a cylindrical housing 22 that has a longitudinally extending X-axis.

Cylindrical housing 22 has a front wall 23, a rear wall 24, a top wall 25, a bottom wall 26, a left side wall 27 and a right side wall 28. A slot or channel 30 is formed in top wall 25 and it communicates with chamber 32 (see FIG. 4). Electrical plug or prong apertures 34 and 35 are formed in front wall 23. A ground pin aperture 36 is also formed in front wall 23. A portion of the rear end of cylindrical housing 22 is relieved to form a pair of laterally spaced cap member support shoulders 38 each having a threaded bore 39. A concave surface 41 extends between the two cap member support shoulders 38. An aperture is formed in concave surface 41 that receives a vertically upstanding pin 43. Its function will be described later.

A pair of channels 45 and 46 extend forwardly from chamber 32 and communicate with the rear end of the respective electrical prong apertures 34 and 35. A left blade prong terminal 48 is captured in channel 45 and positively held in place. A right blade prong terminal 50 is captured in channel 46 and positively held in place. The separator wall 52 extend upwardly from the bottom interior of cylindrical housing 22 between the respective channels 45 and 46.

A vertical groove 54 extends downwardly along left side wall 27 and it has a bore hole 55 that aligns with the bore hole 56 in separator wall 52. A shaft 58 having a Y-axis and a knob 59 on its front end is removably insertable into the respective bore holes 55 and 56. A transversely extending groove 60 is formed in the top surface of shaft 58 and a threaded pin 61 is screwed into threaded bore hole 62 so that it will travel across groove 60 and prevent withdrawl of shaft 58. A transversely extending groove 64 is formed in the bottom surface of shaft 58 and the manner in which it functions will be described later. Knob 59 has a rear wall 65 having an arcuate groove 66 formed therein. A pin 68 extending outwardly from groove 54 is captured in groove 66 and it controls the number of degrees of rotation that knob 59 may be turned.

A plug 70 has a slot 69 formed in its left side wall 71 and its front wall 72 for receiving ground pin socket 74. A transversely extending groove 75 is formed in bottom wall 76 so that shaft 58 can pass uninterrupted beneath plug 70. Plug 70 has a top wall 77 having a bore hole 78 therein for receiving a screw 79 that that threads into threaded bore 80 in bottom wall 81 of chamber 32.

A cap member 84 has a pair of laterally spaced bore holes 85 for receiving screws 86 that are threaded into threaded bores 39. Cap member 84 has an arcuate bottom surface 88, a shoulder 89 and a front flange 90. The front end of front flange 90 presses against the rear wall 92 of plug 70 when it is fully inserted in slot 30. A collar 94 is mounted on the front end of 3-wire electrical cord 95. Collar 94 has an aperture 96 in its bottom surface that receives the pin 43 extending upwardly from concave surface 41. Arcuate bottom surface 88 of cap member 84 is pressed downwardly on the top surface of collar 94. Hot wire 98 is connected to left blade prong terminal 48. Neutral wire 99 is connected to right blade prong terminal 50 and ground wire 100 is connected to ground pin socket 74 in one of the conventionally accepted manners practiced with electrical connections.

Figure 6:
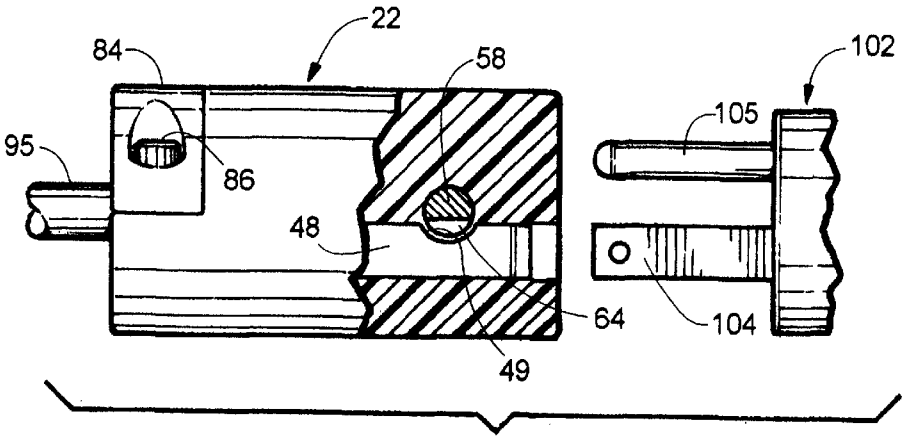
FIG. 6 is an exploded side elevation view of the cylindrical housing and male electrical plug with portions broken away showing the male electrical plug prior to its insertion into the lockable electrical receptacle.
Figure 7:
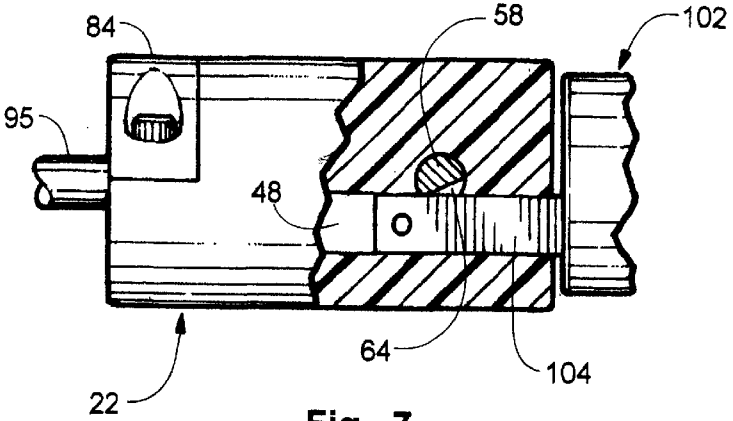
FIG. 7 is a side elevation view of the cylindrical housing with portions broken away showing the male electrical plug inserted into the lockable electrical receptacle and locked in position.
Figure 8:
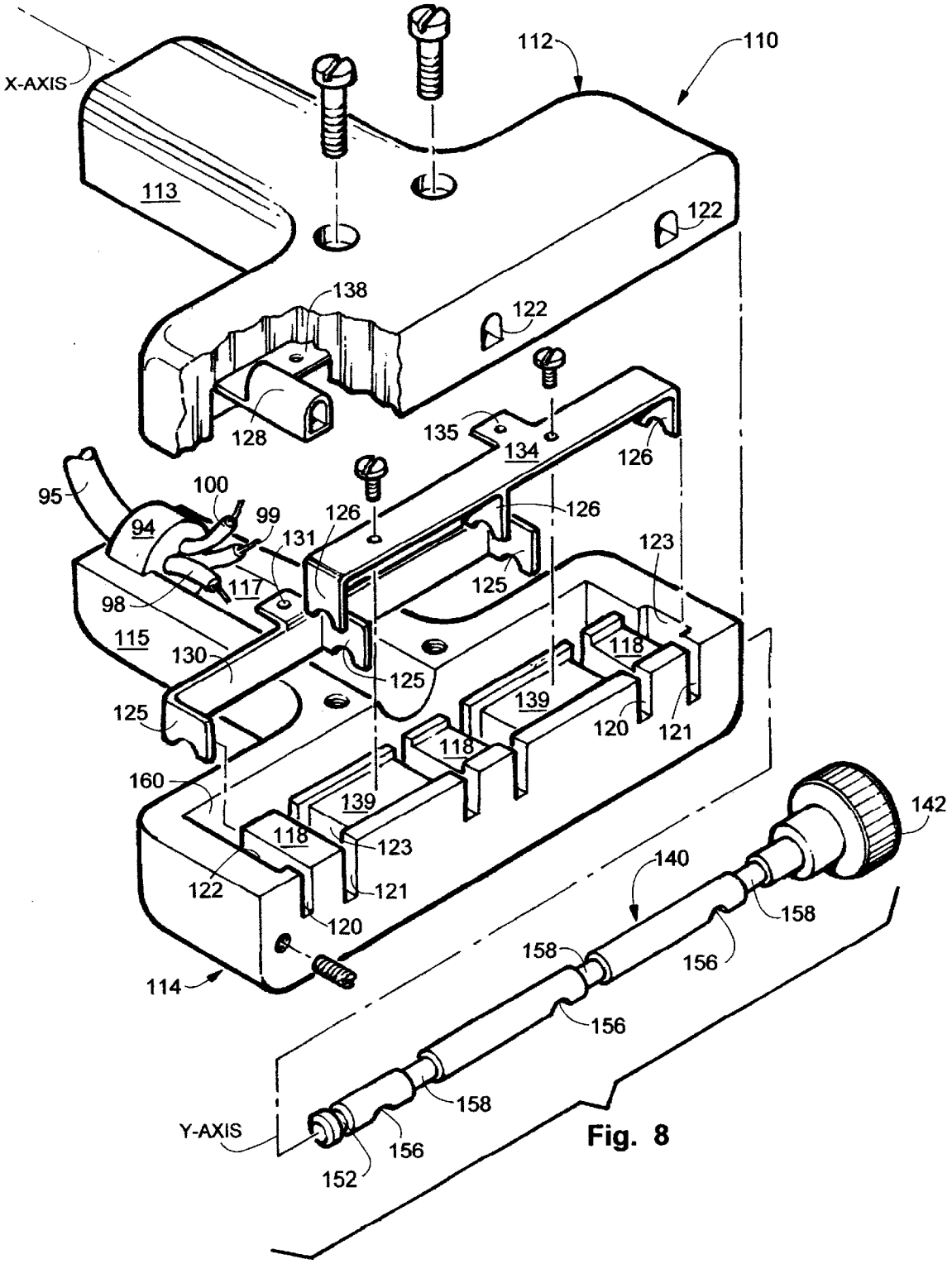
FIG. 8 is an exploded front perspective view of an alternative embodiment of the lockable electrical receptacle.
Figure 9:
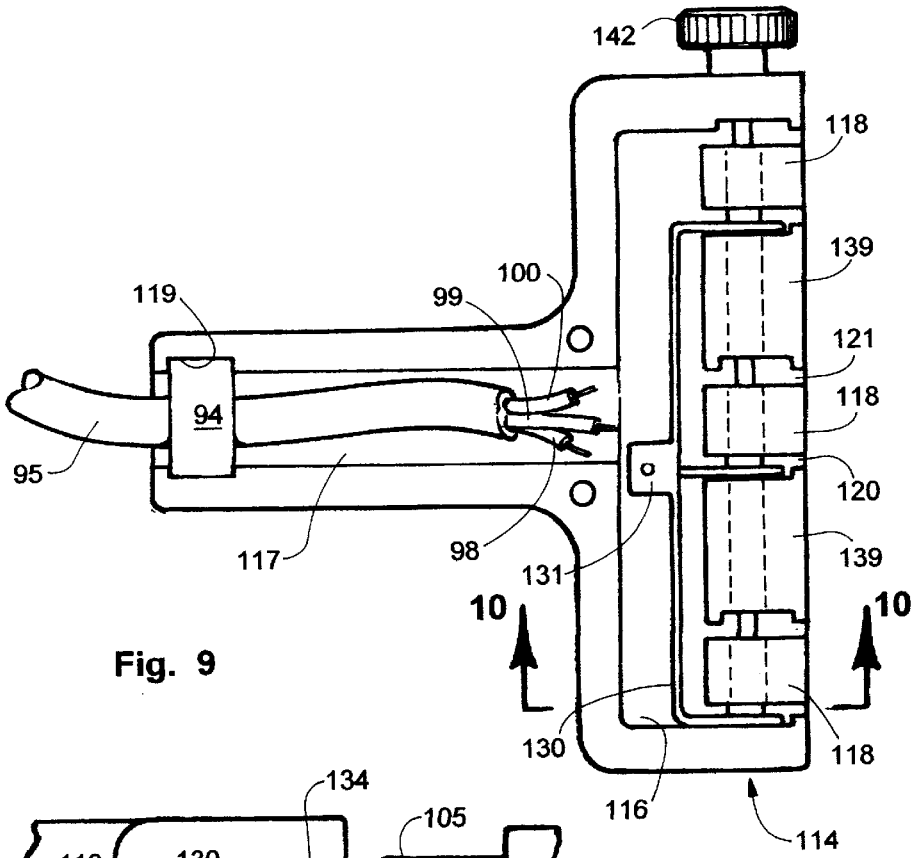
FIG. 9 is a top plan view of the bottom housing member of the alternative embodiment.

Referring to FIGS. 6 and 7, the manner in which a male electrical plug 102 is inserted into lockable electrical receptacle 20 will now be described. The male electrical plug has a pair of laterally spaced blade prongs 104 and also a ground pin 105. shaft 58 has its groove 64 aligned with the left blade prong 104. Left blade terminal 48 has a recess 49 in its top edge that allows unrestricted travel of shaft 58 into bore hole 56. FIG. 7 shows male electrical plug 102 fully inserted into the respective electrical prong apertures 34 and 35 and ground pin aperture 36. Shaft 58 has been rotated a predetermined number of degrees in order to have one edge of groove 64 wedged on frictionally engaged with the top edge of left blade prong 104 and any attempts to withdraw male electrical plug 102 only causes that edge to grip harder against the top edge of blade prong 104. A more explicit description of a similar structure is set forth in U.S. patent application Ser. No. 09/816,702, filed Mar. 26, 2001 and this is incorporated by reference.

The second embodiment of the lockable electrical receptacle will now be described by referring to FIGS. 8–12 of the drawings. The lockable electrical receptacle is generally designated numeral 110. Certain structure in these figures is given the same numerals for like structure in the first described lockable electrical receptacle 20. Lockable electrical receptacle 110 has a housing formed of a cover member 112 and a bottom housing member 114. Cover member 112 has neck portion 113 and bottom housing member 114 has a neck portion 115 and they both have a longitudinally extending X-axis. A concave cylindrical chamber 117 is formed in the respective neck portions 113 and 114 where they meet each other. They also have aligned grooves 119 for capturing collar 94.

The front wall of lockable electrical receptacle 110 has a plurality of sets of electrical prong apertures 120 and 121 and ground pin apertures 122. Spaced inwardly from electrical prong apertures 120 and 121 are channels 123 and 124 that each have a separate wall 118 between them. The respective channels 123 would receive the left blade prong terminal 125. The respective channels 124 would receive the right prong terminal 126. Immediately rearwardly of ground pin apertures 122 are the respective ground pin sockets 128.

The respective left blade prong terminals 125 would be integrally formed with the left electrical conductor bar 130 that has a finger 131 extending rearwardly therefrom that is connected to hot wire 98. The respective right blade prong terminals 126 are integrally formed with right electrical conductor bar 134 that has a finger 135 extending rearwardly therefrom that is connected to neutral wire 99. The respective ground pin sockets 128 are integrally formed with a ground conductor bar 138 that has a finger(not shown) that is connected to ground wire 100 in a similar fashion.

Shaft 140 has a longitudinally extending Y-axis. A knob 142 is formed on its front end. Shaft 140 is removably insertable into aligned bore holes 150 in separator walls 118 and 139. An annular groove 152 at the rear end of shaft 140 captures screw 154 to prevent removal of shaft 140. The respective left blade prong terminals 125 align with transversely extending grooves 156. The portions 158 of shaft 140 align with right blade prong terminals 126. A transversely extending channel 160 is formed in the top surface of bottom housing member 114 to allow left electrical bar 130 to be lowered therein prior to moving it forwardly to properly position the left blade prong terminals 125.

Figure 10:
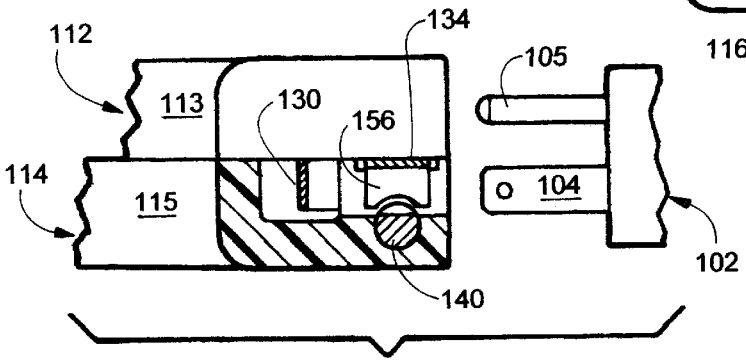
FIG. 10 is a cross sectional view taken along lines 10—10 prior to the male electrical plug being inserted therein.
Figure 11:
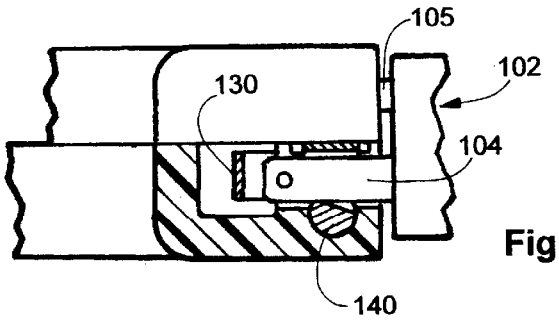
FIG. 11 is a cross sectional view similar to that illustrated in FIG. 10 showing the male electrical plug inserted therein and locked into position.
Figure 12:
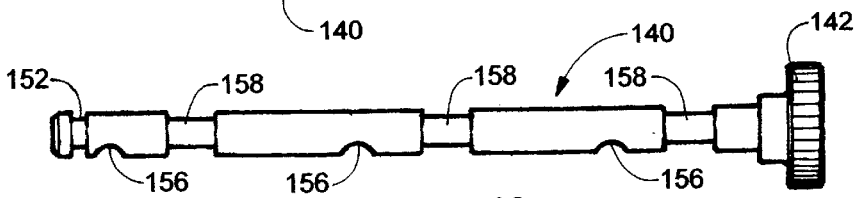
FIG. 12 is a front elevation view of the shaft and the attached locking knob.

Referring to FIG. 10, a cross section illustrates the male electrical plug 102 prior to being inserted into the front end of lockable electrical receptacle 110. In FIG. 11, knob 142 has been rotated causing shaft 140 to force the top edge of respective grooves 156 into a binding locking position with the respective left blade prongs 104.

What is claimed:

1. A lockable electrical receptacle comprising:

a housing having a top wall surface, a bottom wall surface, a front wall surface, a rear wall surface, a left side wall surface, a right side wall surface and a longitudinally extending X-axis; said housing being made of a plastic electrically non-conductive material; a chamber is formed in said housing; at least a first pair of laterally spaced electrical plug apertures are formed in said front wall surface;

each of said first pair of electrical plug apertures having a metallic right blade prong terminal positioned behind a front wall surface in a housing; a metallic left blade prong terminals being electrically connected to an electrical wire of an electrical cord; first means for holding said left blade prong terminals in a substantially fixed position in said housing;

each of said pairs of electrical plug apertures having a metallic left blade prong terminal positioned said front wall surface in said housing; said metallic right blade prong terminals being electrically connected to an electrical wire of an electrical cord; second means for holding said right blade prong terminal in a substantially fixed position in said housing;

a horizontally oriented first shaft having a front end, a rear end, and a longitudinally extending Y-axis; said front end of said first shaft extends outwardly through a bore hole in one of said side wall surfaces of said housing and said shaft is rotatably supported in said bore hole; said Y-axis being vertically positioned a predetermined height spaced apart from said X-axis;

said first shaft having first locking means for gripping at least one of the male blade prongs of a male electrical plug that may be inserted into said first pair of electrical plug apertures formed in said front wall surface of said housing; and first gripping means on said front end of said first shaft for aiding in rotating said first shaft between a locked position and an unlocked position.

2. A lockable electrical receptacle as recited in claim 1 further comprising a ground prong aperture in said front wall surface of said housing adjacent each said pair of laterally spaced electrical plug apertures.

3. A lockable electrical receptacle as recited in claim 1 further comprising means for limiting the numbers of degrees of rotation of said first shaft.

4. A lockable electrical receptacle as recited in claim 1 wherein said housing has a second pair of laterally spaced electrical plug apertures formed in said front wall surface and said second pair of laterally spaced electrical plug apertures are laterally spaced from said first pair of laterally spaced electrical plug apertures.

5. A lockable electrical receptacle as recited in claim 1 wherein said first locking means comprises an annular shoulder on said first shaft and said annular shoulder has a transversely extending groove on its periphery.

6. A lockable electrical receptacle as recited in claim 1 wherein said first gripping means on said front end of said first shaft is a finger gripping knob.

7. A lockable electrical receptacle as recited in claim 1 wherein said housing has a cylindrical shape.

8. A lockable electrical receptacle as recited in claim 3 wherein said means for limiting the number of degrees of rotation on said shaft comprises a finger gripping knob mounted on said front end of said shaft; said knob having a rear wall having an arcuate groove therein; said left side wall housing having a pin extending transversely outwardly therefrom and said pin has a front end that is captured in said arcute groove.

9. A lockable electrical receptacle as recited in claim 1 further comprising means for preventing accidental or unintentional removal of said first shaft from said housing.

10. A lockable electrical receptacle as recited in claim 3 wherein said first and second means for holding said left blade prong terminals and said right blade prong terminal in said housing comprises a pair of laterally spaced channels that form part of said chamber in said housing and a separator wall is positioned between said pair of channels.

11. A lockable electrical receptacle as recited in claim 2 further comprising a slot formed in said top surface of said housing; a plug member is removably received in said slot and said plug has means for removably receiving a ground pin socket.

12. A lockable electrical receptacle as recited in claim 11 further comprising a cap member having a bottom surface that captures said plug member in said slot in said top wall surface of said housing; and a pair of screws to fasten said plug member to said said housing.

13. A lockable electrical receptacle as recited in claim 1 wherein said electrical cord has a front end and said electrical cord has a collar on it adjacent said front end; said collar also having means for securing said collar to said housing and said collar also mating with a shoulder formed on said bottom surface of said cap member.

14. A lockable electrical receptacle as recited in claim 1 wherein said housing is formed of a bottom member and a cover member.

15. A lockable electrical receptacle as recited in claim 14 wherein all of said left blade prong terminals are connected to a single left electrical conductor bar and all of said right blade prong terminals are connected to a single right electrical connector bar.

16. A lockable electrical receptacle as recited in claim 15 further comprising a ground prong aperture in said front wall surface of said housing adjacent each pair of laterally spaced electrical plug apertures.

17. A lockable electrical receptacle as recited in claim 16 further comprising a ground pin socket for each of said pairs of laterally spaced electrical plug apertures.

18. A lockable electrical receptacle as recited in claim 17 wherein all of said ground pin sockets are connected to a single ground pin electrical conductor bar.

* * * * *